US005242282A

United States Patent [19]

Mitsunaga et al.

[11] Patent Number: 5,242,282

[45] Date of Patent: Sep. 7, 1993

[54] SCROLL COMPRESSOR WITH A DRIVING PIN BETWEEN SCROLLS AND A SLIDING SHAFT BEARING

[75] Inventors: Toshihiko Mitsunaga; Yoshinori Noboru, both of Oizumi; Yoshio Ishiai, Ota, all of Japan

[73] Assignee: Sanyo Electric Co., Ltd., Osaka, Japan

[21] Appl. No.: 778,994

[22] PCT Filed: Apr. 15, 1991

[86] PCT No.: PCT/JP91/00491

§ 371 Date: Nov. 13, 1991

§ 102(e) Date: Nov. 14, 1991

[87] PCT Pub. No.: WO91/16543

PCT Pub. Date: Oct. 31, 1991

[30] Foreign Application Priority Data

Apr. 19, 1990 [JP] Japan ..... 2-103332
Apr. 24, 1990 [JP] Japan ..... 2-108510

[51] Int. Cl.[5] ..... F04C 18/04

[52] U.S. Cl. ..... 418/55.2; 418/55.3; 418/55.5; 418/57; 464/102

[58] Field of Search ..... 418/55.2, 55.3, 55.5, 418/57, 188; 464/102, 137

[56] References Cited

U.S. PATENT DOCUMENTS

| | | | |
|---|---|---|---|
| 1,058,457 | 4/1913 | Nielsen | 464/137 |
| 2,841,089 | 7/1958 | Jones | 418/55.3 |
| 4,558,997 | 12/1985 | Sakata et al. | 418/55.2 |
| 4,575,318 | 3/1986 | Blain | 418/188 |
| 4,609,334 | 9/1986 | Muir et al. | 418/55.3 |
| 4,840,549 | 6/1989 | Morishita et al. | 418/188 |
| 4,927,340 | 5/1990 | McCullough | 418/55.3 |

FOREIGN PATENT DOCUMENTS

| | | | |
|---|---|---|---|
| 55-46081 | 3/1980 | Japan . | |
| 57-137677 | 8/1982 | Japan . | |
| 57-49721 | 10/1982 | Japan . | |
| 62-210279 | 9/1987 | Japan . | |
| 62-282186 | 12/1987 | Japan . | |
| 1-302 | 1/1989 | Japan . | |
| 1-273891 | 11/1989 | Japan | 418/55.2 |
| 596752 | 3/1978 | U.S.S.R. | 464/137 |

*Primary Examiner*—John J. Vrablik
*Attorney, Agent, or Firm*—Wenderoth, Lind & Ponack

[57] ABSTRACT

A scroll compressor incorporates an electric motor unit and a scroll compressor unit in a sealed container. The scroll compressor unit has a frame having a bearing at the center thereof, a first scroll driven by the electric motor unit having an end plate and a wrap of an involute curve projecting from the end plate, and a second scroll having an end plate and a wrap of an involute curve projecting from the end plate of the second scroll provided in a juxtaposed relation with the first scroll so that the wraps of the two scrolls are fitted closely together to form a plurality of compression spaces. A driving device rotates the second scroll in the same direction as the first scroll. The driving device has a driving pin disposed on an outer circumference of either the first or second scroll and a guide groove extending in a radial direction of the other of the first or second scroll for receiving the driving pin in such a manner that a circle orbit of an outer circumference of the guide groove is located outside a circle orbit of a center of the driving pin. By this construction, the first scroll driven by the electric motor unit and the second scroll in confronting engagement with the first scroll are rotated in the same direction by a single driving device for compression.

7 Claims, 3 Drawing Sheets

SCROLL COMPRESSOR WITH A DRIVING PIN BETWEEN SCROLLS AND A SLIDING SHAFT BEARING

TECHNICAL FIELD

The present invention relates to a scroll compressor having a driving scroll and a driven (idling) scroll directly rotated by the driving scroll both scrolls being rotated in the same direction.

BACKGROUND OF THE INVENTION

A conventional scroll compressor is shown in, for example, Japanese Patent Publication 62-282186 (unexamined), in which a fixed scroll is positioned stationarily in a sealed container and an orbiting scroll is orbitally moved around a center of the fixed scroll.

However, in the conventional scroll compressor, a driving shaft of the orbiting scroll is cantilevered, with the result that a large vibration is generated particularly in a scroll compressor for high speed purposes. Further, in a large scale compressor, a larger centrifugal force of the orbiting scroll is produced, increasing the load applied to the bearing of the orbiting scroll. Consequently, there are possibilities of a reduction in the efficiency and reliability of operation.

A high speed scroll compressor is disclosed in Japanese Patent Publication 57-49721 (examined), in which two scrolls are rotated, and one of the scrolls is orbitally moved around the other scroll.

This high speed scroll compressor has some serious problems. For example, since the orbiting scroll is orbitally moved around the driving shaft, the orbiting scroll is possibly vibrated abruptly and violently, with the result of a failure in normal high speed operation, with abnormal sounds. Additionally, the two scrolls are rotated in the same direction by employing a coupling ring and a projection formed on an outer circumferential end of a spiral wrap so that a compression space formed by the spiral wraps of the two scrolls is reduced in volume involutely from the outer position to the inner position. Consequently, the structure becomes complex.

In the scroll compressor disclosed in aforementioned Japanese Publication 62-282186, an eccentric bearing for the orbiting scroll is spring-pressed by a resilient member to maintain a radial gap constant between the spiral wrap of the fixed scroll and the spiral wrap of the orbiting scroll so that a predetermined refrigeration capacity can be maintained. However, the eccentric bearing which receives a pin of the orbiting scroll, is pressed by the resilient member and at the same time inserted into a groove of an associated crank member. Accordingly, the orbiting scroll is influenced by the centrifugal force of its own rotation and the spring force of the resilient member. Consequently, there is a serious problem in that the pressure of the orbiting scroll against the fixed scroll becomes excessively large.

SUMMARY OF THE INVENTION

An object of the present invention is to provide an improved scroll compressor of a simple structure of the type having two scrolls rotated in the same direction.

Another object of the present invention is to provide a new scroll compressor incorporating an eccentric bearing for moving a driven (or second) scroll in a radial direction relative to a driving (or first) scroll, in which scroll the eccentric bearing is set unrotatable.

According to the present invention there is provided a scroll compressor incorporating an electric motor unit and a scroll compressor unit in a sealed container. The scroll compressor unit has a frame having a bearing at the center thereof. A first scroll is driven by the electric motor unit and has an end plate and a wrap of an involute curve projecting from the end plate. A second scroll has an end plate and a wrap of an involute curve projecting from the end plate of the second scroll in a juxtaposed relation with the first scroll so that the wraps of the two scrolls are fitted closely together to form a plurality of compression spaces. A driving device rotates the second scroll in the same direction as the first scroll. The driving device has a driving pin disposed on an outer circumference of either the first or the second scroll. A guide groove extends in a radial direction of the scrolls for receiving the driving pin in such a manner that the circle orbit of the outer circumference of the guide groove is located outside the circle orbit of the center of the driving pin.

By this construction, the first scroll, driven by the electric motor unit, and the second scroll, provided in engagement with the first scroll, are rotated in the same direction by a single driving device for compression.

In another aspect of the present invention, a subsidiary frame is provided to support the second scroll. The subsidiary frame has a groove, and an eccentric bearing member is disposed in the groove for movably supporting the second scroll. The eccentric bearing member is formed with an eccentric bushing for rotatably receiving a shaft of the second scroll. Springs hold the eccentric bushing on opposite sides thereof. This structure of the subsidiary frame can be employed even when the coupling between the driving pin and the guide groove is not applied.

According to the present invention, the second scroll is movable in a radial direction relative to the first scroll by the eccentric bearing member so that the radial gap between the spiral wraps of the two scrolls is increased when abnormally high pressure is produced in the compression space between the two undirectionally rotating scrolls.

PREFERRED EMBODIMENT OF THE INVENTION

Figure 1:
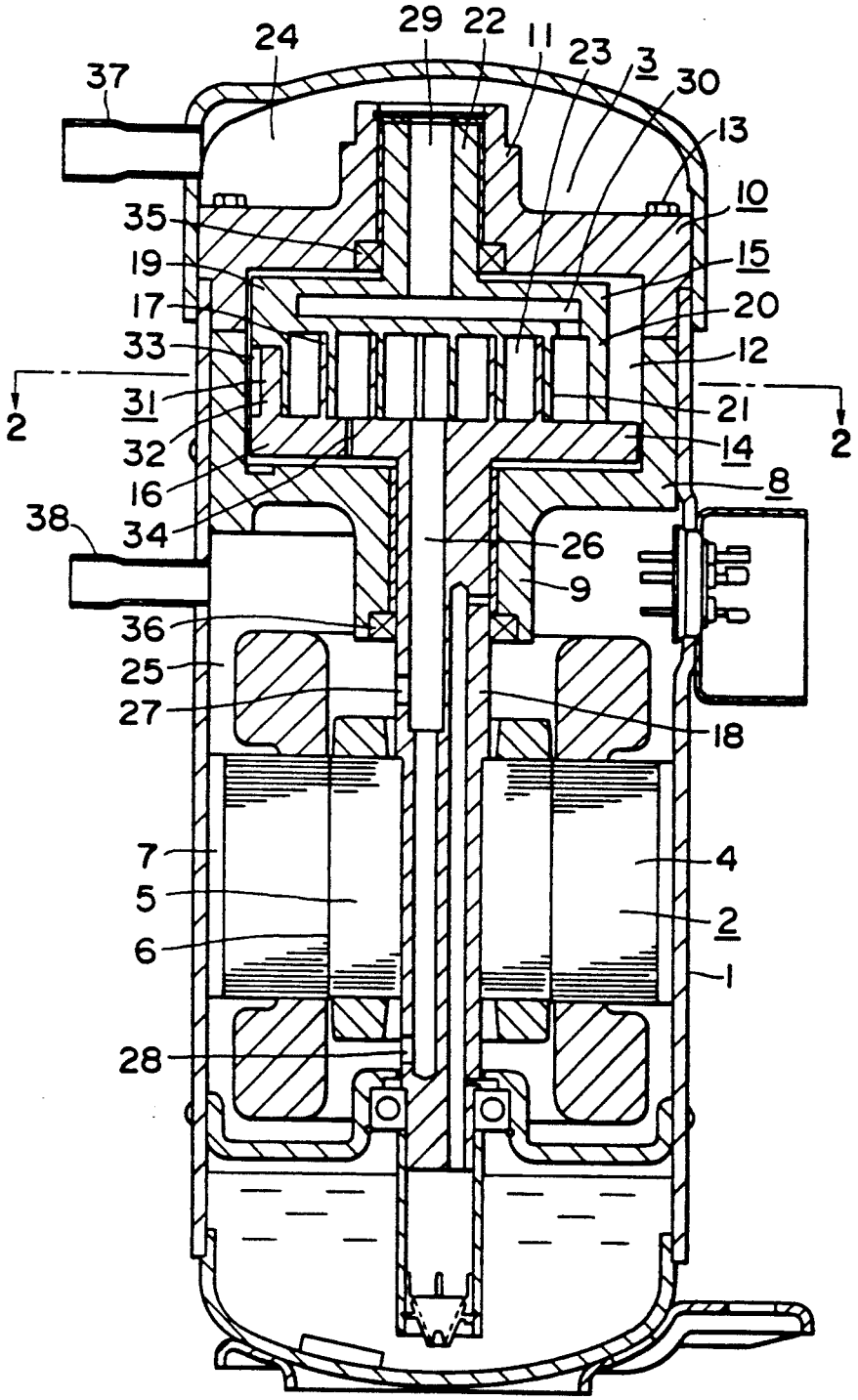
FIG. 1 is a sectional elevation of a scroll compressor embodying the present invention.

A first preferred embodiment of the present invention will be described with reference to FIGS. 1-3.

An electric motor unit 2 and a scroll compressor unit 3 are disposed at a lower portion and an upper portion, respectively, of a sealed container 1. The electric motor unit 2 has a stator 4 and a rotor 5 inside the stator with an air gap 6 therebetween. A passage 7 is formed on the outer surface of the stator 4 by partly cutting out the outer surface of the stator. A main frame 8 is press-fitted to an inner surface of the sealed container 1 and is provided with a main bearing 9 at a center thereof and, similarly, a subsidiary frame 10 is press-fitted to the inner surface of the sealed container 1. The subsidiary frame 10 has a subsidiary bearing 11 at its center, and the main frame 8 and the subsidiary frame 10 are connected together by bolts 13 to form a chamber 12.

The scroll compressor unit 3 has a first scroll 14 (i.e. a driving scroll) second scroll 15 (i.e. an idler or driven scroll) rotated in the same direction as the driving scroll 14. The driving scroll 14 has a disc end plate 16, a spiral wrap 17 extending from an upper surface of the end plate 16 in an involute curve configuration, and a driving shaft 18 projecting from the center of the lower surface of the end plate 16 to be fitted fixedly into a bore of the rotor 5. The driven scroll 15 has a tubular end plate 19, an annular wall 20 projecting from an outer circumference of the end plate 19 to slidably contact the end plate 16 of the driving scroll 14, a spiral wrap 21 extending from a lower surface of the end plate 19 in an angle-corrected involute curve configuration inside the annular wall 20, and an idler shaft 22.

The spiral wrap 17 of the driving scroll 14 has coordinates which are obtained by:

$$X=R\ (\cos\theta+\theta\sin\theta)$$

$$Y=R\ (\sin\theta-\theta\cos\theta),$$

and the spiral wrap 21 is an angle-corrected involute curve of the driven scroll 15 and has coordinates which are obtained by:

$$X=-R\ [\cos\theta+(\theta+\beta)\sin(\theta+\beta)]$$

$$Y=-R\ [\sin\theta-(\theta+\beta)\cos(\theta+\beta)]$$

$$\beta=\tan^{-1}\{P\sin\theta/(P\cos\theta+\epsilon)\},$$

wherein:

R:a radius of a basic circle,

P:a radius of a circle orbit of a driving pin, $\theta$:a rotational angle of the driving shaft, and $\epsilon$:the eccentric distance between the driving scroll and the driven scroll.

The driving shaft 18 of the driving scroll 14 is journalled main bearing 9 of the main frame 8, and the idler 22 of the driven scroll 15 is journalled on the subsidiary bearing 11. The driving scroll 14 and the driven scroll 15 are placed in a confronting engagement relation in the chamber 12 so that the wraps 17 and 21 of the two scrolls 14 and 15 are contacted with each other at a plurality of points to form a plurality of compression spaces 23.

The interior of the sealed container 1 is divided into a low pressure chamber 24 and a high pressure chamber 25 by the main frame 8 and the subsidiary frame 10.

The driving shaft 18 has a discharge port 26 for discharging therethrough a compressed refrigerant in the compression space 23 into the high pressure chamber 25. The discharge port 26 has an upper opening 27 and a lower opening 28, both the openings 27 and 28 being connected to the high pressure chamber 25.

The idler shaft 22 has a suction port 29 for directing the refrigerant in the low pressure chamber 24 to the compression space 23. The end plate 19 has a channel 30 which is connected to the suction port 29 for directing the refrigerant inwardly into the compression space 23.

A driving device 31 has a driving pin 32 projecting from an outer circumference of the end plate 16 of the driving scroll 14 and a guide groove 33 extending in a radial direction on the annular wall 20 of the driven scroll 15 for receiving therein the driving pin 32. The guide groove 33 is formed in a U-shape by cutting an outer portion of the driven scroll 15 so that a circle orbit of the outer circumferential end of the guide groove 33 is positioned outside a circle orbit of the center of the driving pin 32.

The end plate 16 of the first scroll 14 has a small through-hole 34 which connects the compression space at mid-compression with the chamber 12. The chamber 12 and the low pressure chamber 24 are hermetically sealed and shielded from each other by a sealing member 35 disposed on a sliding surface of the subsidiary bearing 11 of the subsidiary frame 10 relative to the idler shaft 22 of the driven scroll 15. Similarly, the chamber 12 and the high pressure chamber 25 are hermetically sealed by a sealing member 36 disposed on a sliding surface of the main bearing 9 of the main frame 8 relative to the driving shaft 18 of the driving scroll 14.

A suction pipe 37 is disposed at an upper portion of the sealed container so that it is connected with the low pressure chamber 24, and a discharge pipe 38 is disposed adjacent the lower portion of the main frame so that it is connected with the high pressure chamber 25.

Figure 2:
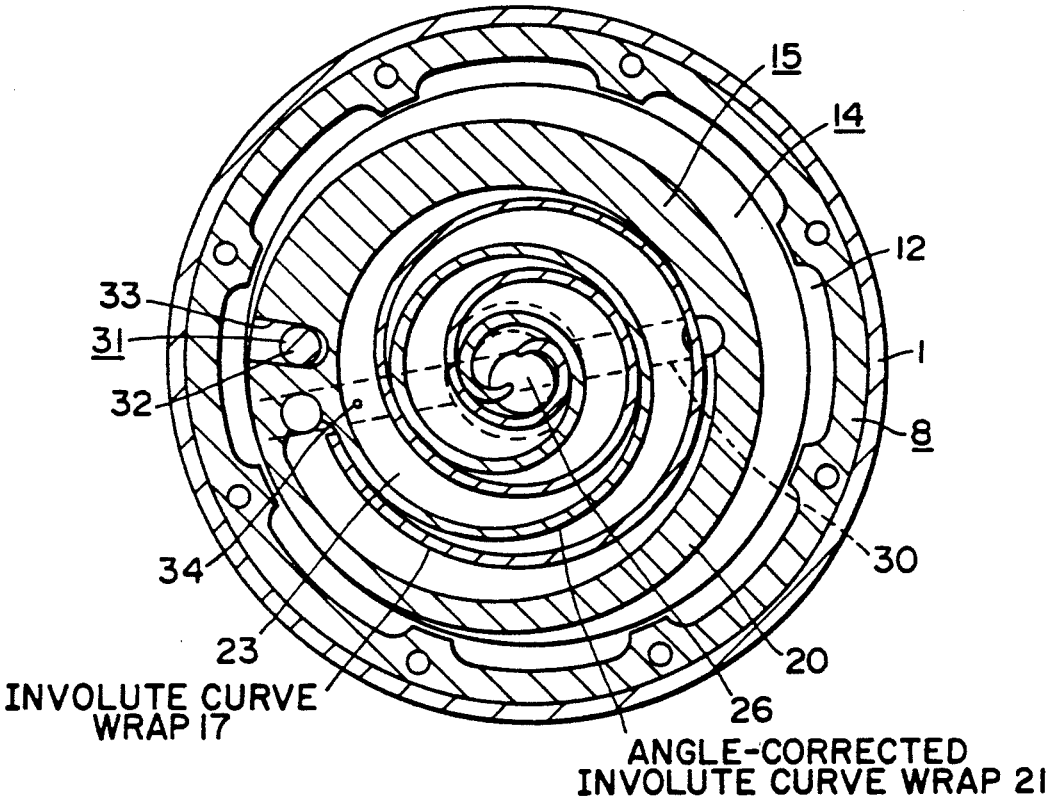
FIG. 2 is a sectional view taken along line 2—2 in FIG. 1.
Figure 3:
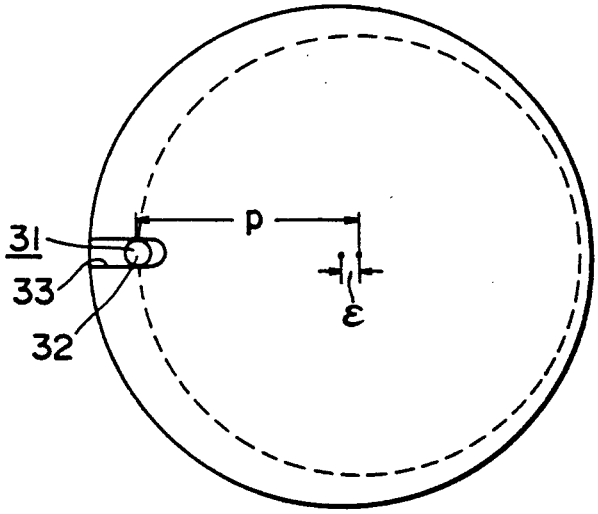
FIG. 3 is a diagram showing the rotational orbit of the center of a driving pin for the two scrolls and the rotational orbit of the outer circumference of a guide groove.

In the scroll compressor shown in FIGS. 1-3, when the electric motor unit 2 is driven, the first or driving scroll 14 is rotated through the main driving shaft 18, and then a rotational force of the driving scroll 14 is delivered to the second or driven scroll through the driving device 31. Thus, the driven scroll 15 is rotated in the same direction as the driving scroll 14. The idler shaft 22 of the driven scroll 15 is eccentrically spaced from the driving shaft 18 of the driving scroll 14 by a distance "$\epsilon$", and accordingly the driven scroll 15 is eccentrically rotated relative to the driving scroll 14. Thus, the compression space 23 is gradually reduced in its volume as it is moved inwardly from an outer position to an inner position of the spiral wraps, and the refrigerant flowing from the suction pipe 37 into the low pressure chamber 24 is directed into the compression space 23 to be compressed through the suction port 29 and the channel 30 of the end plate 19. The thus compressed refrigerant is fed to the discharge port 26 of the main driving shaft 18 of the driving scroll 14, fed to the high pressure chamber 25 through the discharge openings 27 and 28, and then discharged out of the sealed container through the discharge pipe 38. If the refrigerant is in a mid-compression stage and is of a middle pressure, it is discharged into the chamber 12 from the small through-hole 34 so that it serves as a back pressure to the two scrolls 14 and 15, and the ends of the two spiral wraps 17 and 21 of the driving and driven scrolls are slidably moved along the surfaces of the end plates 16 and 19 with a constant clearance maintained between the two ends of the wraps.

As described, the second or driven scroll 15 is rotated in the same direction as the first or driving scroll 14 by means of the driving device 31 and the driving device is constructed in such a manner that a circle orbit of the outer circumference of the guide groove 33 is located outside a circle orbit of a center of the driving pin 32. By this construction, the driving pin 32 is snugly and reliably received in the guide groove 33 without removal therefrom, and only a single driving pin 32 can rotate the two scrolls in the same direction to gradually reduce the volume of the compression space 23 for predetermined compression purposes. Further, the center of the driving scroll 14 is deviated or spaced from the center of the driven scroll 15 by a distance "ε" and the spiral wrap 17 of the driving scroll 14 is formed in an involute curve configuration, whereas the spiral wrap 21 of the driven scroll 15 is formed in an angle-corrected involute curve configuration. This construction permits suitable contact between the two wraps 17 and 21 and prevents one wrap from releasing from, and abnormally press-fitting against, the other wrap so that a preferable compression is attained by the compression space 23.

Since the low pressure chamber 24 and the high pressure chamber 25 are hermetically sealed by the sealing members 35 and 36, refrigerant of low pressure or of high pressure is prohibited from flowing into the chamber 12 within the main and subsidiary frames 8 and 10 so that the predetermined middle pressure can be maintained in the chamber 12. Thus, a suitable sealing force in the axial direction of the two scrolls 14 and 15 can be maintained.

The compressed refrigerant in the compression space 23 is discharged from the upper opening 27 and the lower opening 28 into the high pressure chamber 25 through the discharge port 26 and, therefore, pressure reduction of the refrigerant discharged into the high pressure chamber 25 can be prevented. In addition, the refrigerant from the lower discharge opening 28 is directed to the discharge pipe 38 through the air gap 6 and the passage 7 of the electric motor unit 2 to efficiently cool the electric motor unit 2 and, at the same time, effectively utilize the heat of the electric motor unit 2.

In the present invention, a predetermined compression is achieved by rotating the driven scroll 15 in the same direction as the driving scroll 14 by means of a single driving pin, such as the driving pin 32. Thus, orbiting movement of either driving or driven scroll 14 and 15 and any vibration generated by such an orbiting movement can be prevented. In addition, the rotation of the two scrolls in the same direction can provide suitable compression by the compression space 23.

In the illustrated embodiment of the present invention, the description has been made that one of the spiral wraps is formed in an involuted curve configuration and the other in an angle-corrected involute curve configuration, and yet modifications can be made by forming the spiral wrap in a semi-circular spiral shape in each of the two scrolls. In this modification, the two scrolls are rotated in the same direction by a single driving pin and a desired compression can be achieved.

According to the present invention, the driving device is formed with the combination of the driving pin projecting from an outer circumference of either driving or driven scroll and the guide groove extending radially on the end plate of the other scroll so that a circle orbit of the outer end of the guide groove is located outside a circle orbit of the center of the driving pin. Therefore, rotation of the two scrolls in the same direction can form a gradually reducing compression space for compression purposes without unnecessary vibration and noise of the scrolls in high speed operation.

Figure 4:
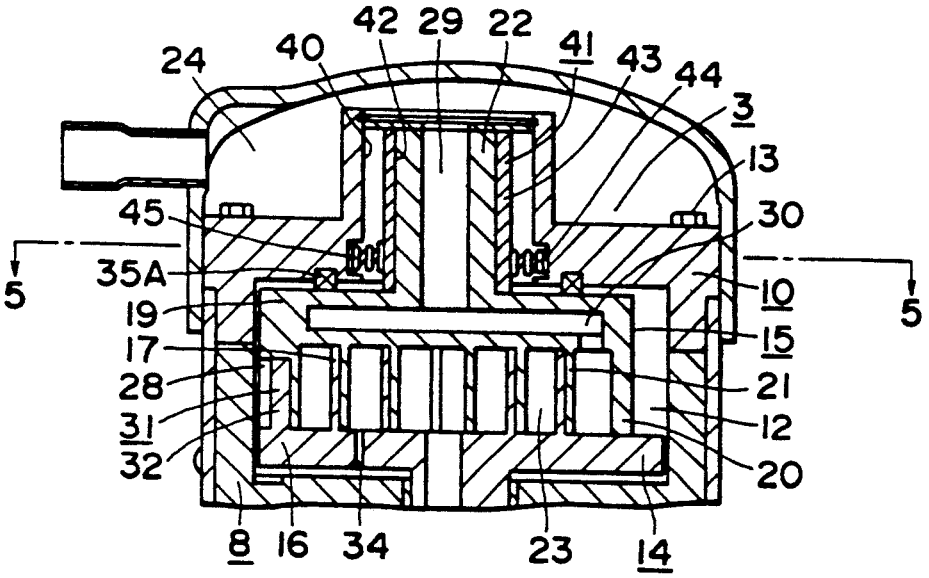
FIG. 4 is a partially sectional elevation of a scroll compressor according to another embodiment of the invention.
Figure 5:
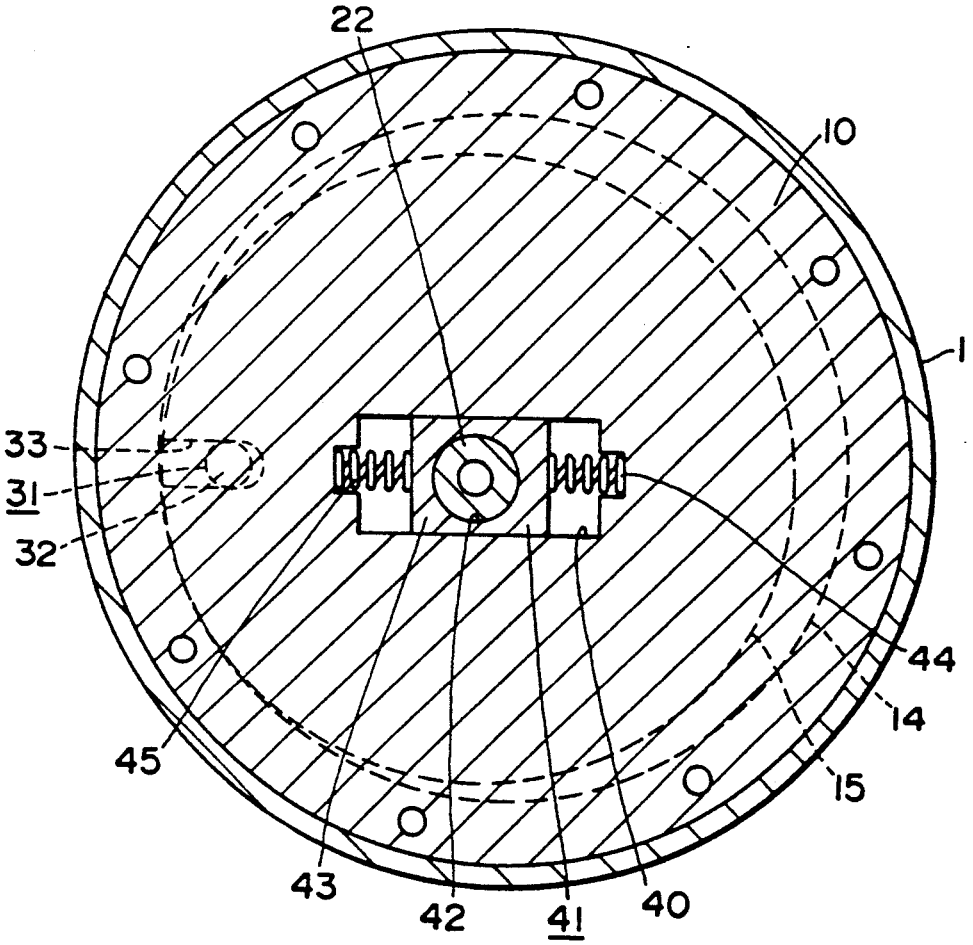
FIG. 5 is a sectional view taken along line 5—5 in FIG. 4.

In FIGS. 4 and 5, which show another embodiment of the present invention, the subsidiary frame 10 has an elongated sliding groove 40 for slidably receiving therein an eccentric bearing 41. The eccentric bearing 41 has an eccentric bushing 43 which has a hole 42 for rotatably receiving the idler shaft 22 of the driven scroll 15, and coil springs 44 and 45 for resiliently holding the eccentric bushing 43 from opposite sides thereof. In the embodiment of FIGS. 4 and 5, a sealing member 35A, which corresponds to the sealing member 35 in FIGS. 1–3, is disposed on a sliding surface of the end plate 19 of the driven scroll 15 to hermetically seal the chamber 12 from the low pressure chamber 24 by the subsidiary frame 10.

In the embodiment of FIGS. 4 and 5, when the electric motor unit 2 is driven, a rotational force of the rotor 5 is delivered to the driving scroll 14 through its driving shaft 18, and at the same time to the driven scroll 15, so that the driven scroll 15 is rotated in the same direction as the driving scroll 14. The center of the idler shaft 22 of the driven scroll 15 is deviated, or spaced, from the center of the driving shaft 18 of the driving scroll 14 by means of the eccentric bearing 41 fitted in the sliding groove 40 so that the idler shaft 22 is eccentrically rotated relative to the driving shaft 18.

The eccentric bearing 41 is formed with the eccentric bushing 43 having the hole 42 for receiving the idler shaft 22 and the springs 44 and 45 for holding the eccentric bushing 43 as described so that the idler shaft 22 is eccentrically spaced from the driving shaft 18. Since the eccentric bushing 43 is resiliently secured in the sliding groove 40 by the springs 44 and 45, the eccentric bushing 43 is slidably moved in the elongated sliding groove 40 against the resilient force of the springs 44 and 45 when an abnormally high pressure is produced in the compression space 23, so that the wrap 21 of the driven scroll 15 is slightly released from the wrap 17 of the driving scroll 14. Further, the eccentric bearing 41 is not rotated and no centrifugal force is added to the springs 44 and 45 which holds the bushing 43. Consequently, the spring constant of the springs 44 and 45 is unchanged.

According to the present invention, the subsidiary frame is provided with a sliding groove for slidably securing therein an eccentric bearing so that the driven (or second) scroll is movably supported by the eccentric bearing, and the eccentric bearing is formed with an eccentric bushing and spring device for resiliently securing the bushing. This structure permits the reliable securement of the driven scroll in normal operation, and also releases the driven scroll from the driving scroll when an abnormally high pressure is produced in the compression space so that damage of the elements in the scroll compressor can be prevented.

What is claimed is:

1. A scroll compressor, comprising:

a sealed container having a fluid inlet and a fluid outlet;

an electric motor unit disposed in said sealed container; and a compressor unit, said compressor unit comprising:

a frame fixed in said container having a bearing at the center thereof, a first scroll rotatably supported by said bearing on said frame and connected to and rotatably driven by said electric motor unit, said first scroll having an end plate and a wrap on one surface of said end plate, a second scroll rotatably mounted in said container, said second scroll having an end plate and a wrap attached to one surface of said end plate, said second scroll being positioned in a juxtaposed relation with said first scroll such that said wraps of said first and second scrolls are fitted closely together to form a plurality of compression spaces, wherein the rotational axis of said second scroll is eccentrically spaced from the rotational axis of said first scroll, a driving means for rotating said second scroll in the same direction as said first scroll, said driving means comprising a driving pin projecting from one of said end plates toward the other said end plate and a guide groove receiving said pin therein formed on the other said end plate, said guide groove having an outer end which, upon rotation, defines a circular orbit that is located outside the circular orbit of said driving pin, and passages connecting an outer portion of said scrolls with said fluid inlet and an inner portion of said scrolls with said fluid outlet;

wherein one of said wraps of said first and second scrolls has the shape of an involute curve and the other of said wraps of said first and second scrolls has the shape of an angle-corrected involute curve.

2. The scroll compressor of claim 1, wherein said compressor unit further comprises a subsidiary frame fixed in said container, said subsidiary frame having a bearing rotatably supporting said second scroll.

3. The scroll compressor of claim 2, wherein said scrolls have shafts connected with the respective said end plates rotatably supported by the respective said bearings.

4. The scroll compressor of claim 3, wherein said bearing of said subsidiary frame is eccentrically and slidably mounted in a sliding groove of said subsidiary frame, said bearing comprising an eccentric bushing receiving said shaft of said second scroll and a spring device resiliently securing said eccentric bushing in said sliding groove.

5. The scroll compressor of claim 4, wherein said spring device comprises a pair of coil springs resiliently holding said eccentric bushing from opposite sides thereof.

6. The scroll compressor of claim 1, wherein:

one of said scrolls has an annular wall extending from the outer circumference of said end plate thereof toward the other said scroll;

said annular wall surrounds said wraps of both said scrolls; and said guide groove of said driving means extends radially into said annular wall from the outer periphery thereof.

7. The scroll compressor of claim 6, wherein said annular wall and said guide groove are on said second scroll.

* * * * *